US008955191B2

(12) United States Patent
Patterson et al.

(10) Patent No.: US 8,955,191 B2
(45) Date of Patent: Feb. 17, 2015

(54) SURFACE CLEANING TOOLS HAVING END CAPS

(71) Applicant: Unger Marketing International, LLC, Bridgeport, CT (US)

(72) Inventors: Joseph K. Patterson, Monroe, CT (US); Paul Adams, Monroe, CT (US); Bernard Bensussan, Monroe, CT (US); Anthony Sgroi, Jr., Wallingford, CT (US); Kai Hirsch, Cologne (DE); Daniel Ferrara, Morris, CT (US)

(73) Assignee: Unger Marketing International, LLC, Bridgeport, CT (US)

( * ) Notice: Subject to any disclaimer, the term of this patent is extended or adjusted under 35 U.S.C. 154(b) by 0 days.

(21) Appl. No.: 14/247,327

(22) Filed: Apr. 8, 2014

(65) Prior Publication Data

US 2014/0215795 A1 Aug. 7, 2014

Related U.S. Application Data

(62) Division of application No. 12/986,381, filed on Jan. 7, 2011, now Pat. No. 8,726,451.

(51) Int. Cl.
*A47L 1/06* (2006.01)

(52) U.S. Cl.
CPC ..... *A47L 1/06* (2013.01)
USPC ..... 15/245; 15/257.01

(58) Field of Classification Search
CPC ..... A47L 1/06
USPC ..... 15/121, 245, 257.01
See application file for complete search history.

(56) References Cited

U.S. PATENT DOCUMENTS

| | | | |
|---|---|---|---|
| 202,101 | A | 4/1878 | Gayton |
| 2,112,462 | A | 3/1938 | Nykyfor |
| 2,123,638 | A | 7/1938 | Ettore |
| 2,814,822 | A | 12/1957 | Page |
| 2,905,960 | A | 9/1959 | Ward |
| D298,072 | S | 10/1988 | Stirling |
| 4,777,694 | A | 10/1988 | Young |
| 4,847,938 | A | 7/1989 | Unger |
| 5,381,581 | A | 1/1995 | Samuelsson |
| 6,625,840 | B1 | 9/2003 | Hansen |
| 6,931,690 | B2 | 8/2005 | Cox |
| 7,000,282 | B2 | 2/2006 | Cox et al. |
| 7,748,074 | B2 | 7/2010 | Guizzi |
| D627,532 | S | 11/2010 | Yang et al. |
| D632,857 | S | 2/2011 | Sgroi et al. |
| D634,496 | S | 3/2011 | Porco |

FOREIGN PATENT DOCUMENTS

EP 0215564 A1 3/1987

OTHER PUBLICATIONS

European Search Report dated Jan. 10, 2012 from European Application No. 11194518.4.

*Primary Examiner* — Randall Chin
(74) *Attorney, Agent, or Firm* — Ohlandt, Greeley, Ruggiero & Perle, LLP

(57) ABSTRACT

An end cap having a longitudinal axis is provided. The end cap includes a stationary portion, a movable portion, and a clamping member. The movable portion has a cam surface and the clamping member has a free end. The movable and stationary portions are interconnected so that the movable portion moves between a locked position and an unlocked position. The cam surface influences the clamping member when the movable portion is in the locked position such that the cam surface resiliently flexes the clamping member to move the free end at least perpendicular to the longitudinal axis.

20 Claims, 21 Drawing Sheets

SURFACE CLEANING TOOLS HAVING END CAPS

CROSS REFERENCE TO RELATED APPLICATIONS

This application is a divisional of U.S. application Ser. No. 12/986,381 filed Jan. 7, 2011, now U.S. Pat. No. 8,726,451, the entire contents of which are incorporated herein by reference.

BACKGROUND OF THE INVENTION

1. Field of the Invention

The present disclosure is related to tools for cleaning surfaces such as glass. More particularly, the present disclosure is related to surface cleaning tools that include a handle supporting a channel having a wiper blade, which is held in the channel by end caps.

2. Description of Related Art

Surface cleaning tools are known that have a handle securing a channel assembly, which includes a channel with a wiper or squeegee blade (hereinafter "blade") secured in the channel. Such tools are typically used to wipe away debris, water, cleaning fluid, and other materials from surfaces such as, but not limited to glass windows, glass mirrors, and other flat surfaces. These surface cleaning tools are commonly referred to as "squeegees".

In many instances, the tools are used to clean surfaces of tall buildings or skyscrapers and are typically used under difficult working conditions such as while standing on a suspended platform, when secured to a safety harness, and while using personal protection equipment like gloves, as well as when exposed to high winds and extreme temperatures.

During use of such surface cleaning tools, it can be important for the blade to remain in a taut or tensed condition so that the blade leaves the surface free of streaks. It can also be important to ensure that the blade does not wander or move within the channel. If the blade were to move within the channel during use, the exposed edges of the channel can be exposed to and damage or scratch the surface being cleaned and/or surfaces adjacent to the surface being cleaned (e.g., window sills).

Some prior art tools are sold with components that the user can place between the blade and the channel to keep the blade from sliding out of the rigid channel, to maintain the blade in the tensed condition, and prevent the terminal end of the blade from being pushed into the rigid channel during use. In fact, some users have taken to using toothpicks to accomplish this function.

Unfortunately, the prior art solutions can be difficult to use, particularly when faced with the difficult working conditions present when cleaning the surfaces of tall buildings or skyscrapers, especially when wearing working gloves.

Accordingly, it has been determined by the present disclosure that there is a continuing need for surface cleaning tools that overcome, alleviate or mitigate one or more of the aforementioned or other deleterious attributes of prior art cleaning tools.

BRIEF SUMMARY OF THE INVENTION

A surface cleaning tool is provided that includes a handle assembly, a channel, a blade, and a pair of end caps configured to secure the blade in a desired position in the channel.

An end cap having a longitudinal axis is provided. The end cap includes a stationary portion, a movable portion, and a clamping member. The movable portion has a cam surface and the clamping member has a free end. The movable and stationary portions are interconnected so that the movable portion moves between a locked position and an unlocked position. The cam surface influences the clamping member when the movable portion is in the locked position such that the cam surface resiliently flexes the clamping member to move the free end at least perpendicular to the longitudinal axis.

A channel assembly is also provided that includes a channel, a wiper blade in the channel, and end caps at opposite ends of the channel. The channel has a longitudinal axis and the wiper blade is disposed in the channel along the longitudinal axis.

In some embodiments, the end caps each include an engagement region in which the channel is received, an extension region that extends outward from the engagement region along the longitudinal axis, and a clamping member having a free end movable into engagement and disengagement with the wiper blade. The free end is within the extension region of the end cap.

In other embodiments, the end caps include a movable portion, a stationary portion, and a clamping member. The clamping member has a free end that is engaged with the wiper blade when the movable portion is in the locked position, but is at least partially disengaged from the wiper blade when the movable portion is in the unlocked position.

A method of securing a wiper blade in a channel is also provided. The method includes connecting a pair of end caps to each end of the channel; moving a movable portion of the end caps to an unlocked position; inserting the wiper blade into the channel; and moving the movable portion of the end caps to a locked position such that a clamping member of the end caps engages the wiper blade.

The above-described and other features and advantages of the present disclosure will be appreciated and understood by those skilled in the art from the following detailed description, drawings, and appended claims.

DETAILED DESCRIPTION OF THE INVENTION

Figure 1:
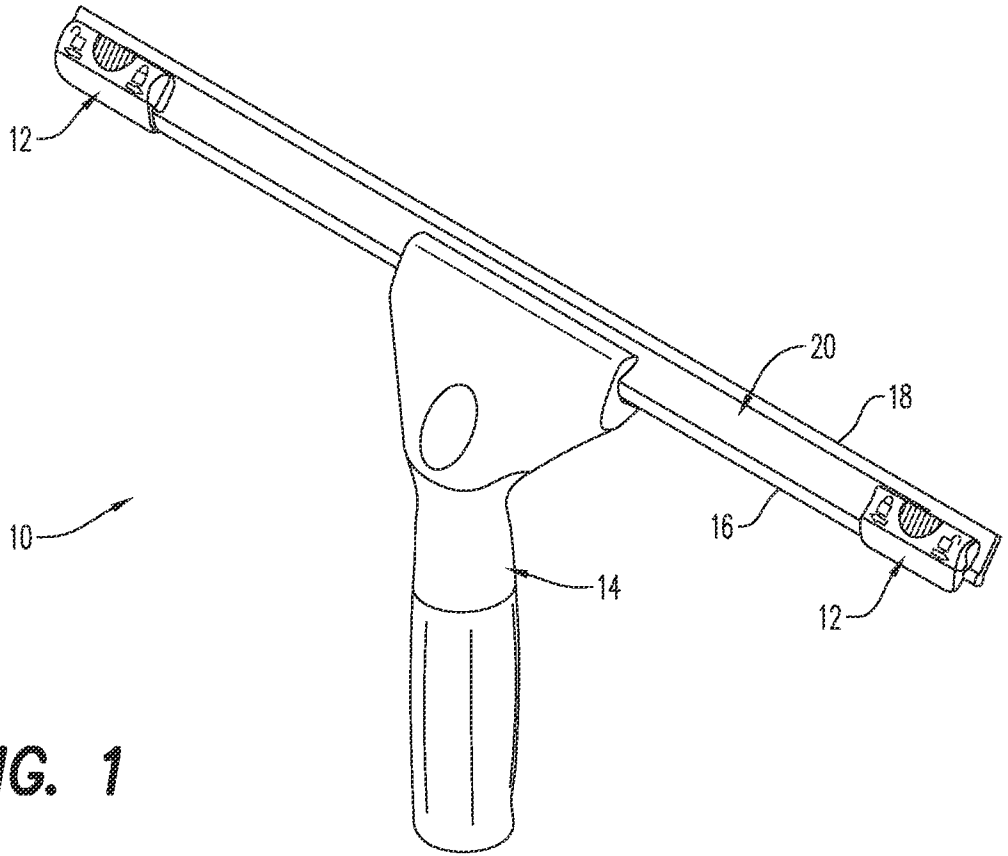
FIG. 1 is front perspective view of an exemplary embodiment of a surface cleaning tool according to the present disclosure.
Figure 2:
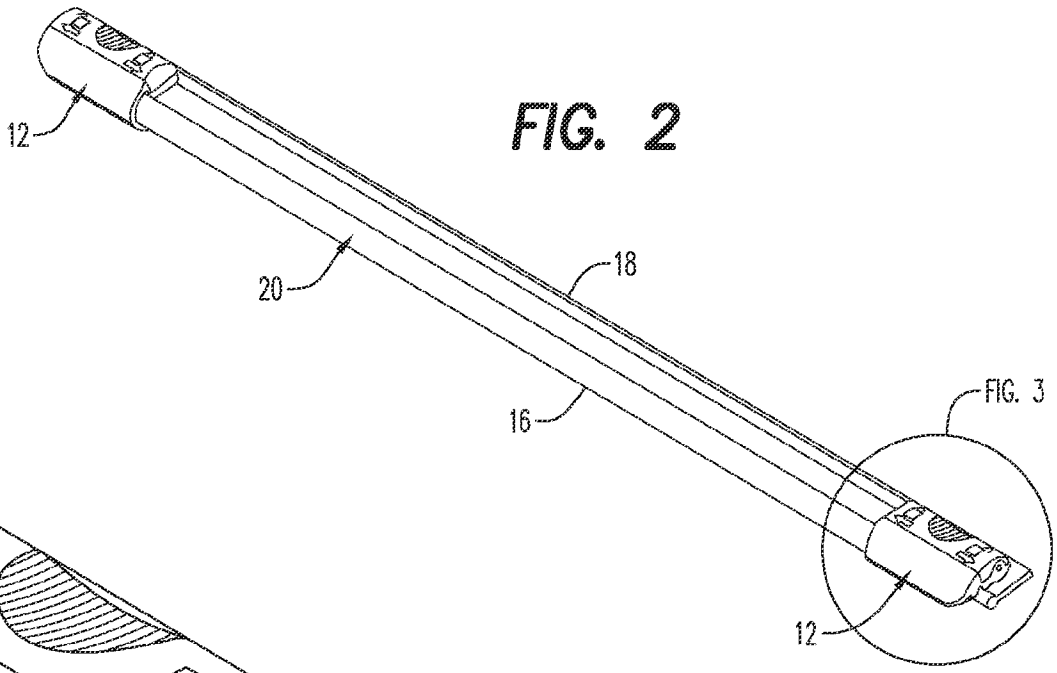
FIG. 2 is a front perspective view of an exemplary embodiment of a channel assembly for use with the tool of FIG. 1.
Figure 3:
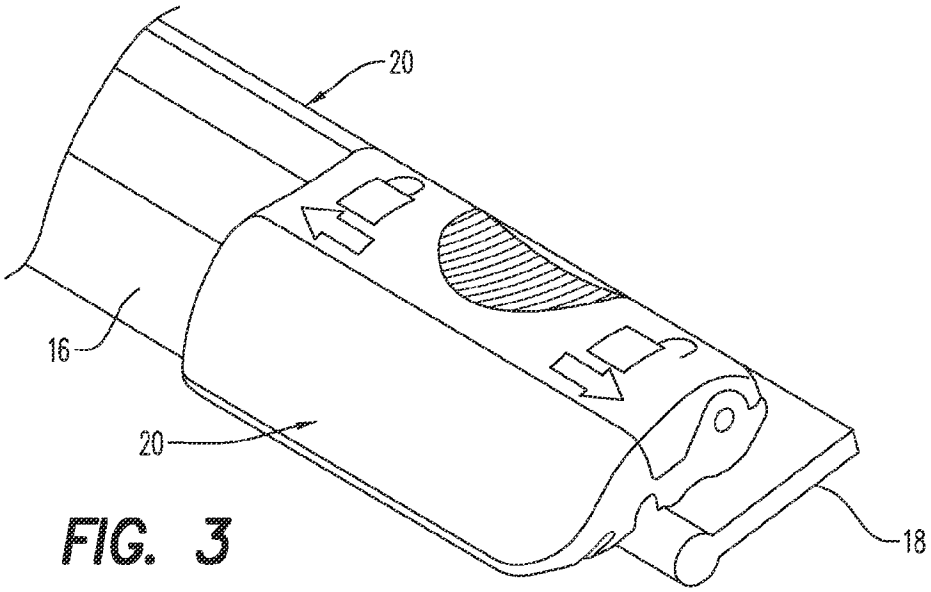
FIG. 3 is a magnified view of an exemplary embodiment of an end cap of the channel assembly of FIG. 2 shown in a locked position.

Referring to the drawings and in particular to FIGS. 1 through 3, a surface cleaning tool according to the present disclosure is shown and is generally referred to by reference numeral 10.

Tool 10 includes a pair of end caps 12, a handle assembly 14, a channel 16, and a wiper blade 18. End caps 12, channel 16, and blade 18, when assembled together form a channel assembly 20, which can be secured to handle assembly 14. In this manner, tool 10 is configured to move blade 18 along a surface such as, but not limited to, glass windows, glass mirrors, counters, griddles, shower walls, and other flat surfaces to wipe away debris, water, cleaning fluid and other materials from the surface.

Advantageously, end caps 12 can ensure that blade 18 does not wander or move axially within the channel during use. Further, end caps 12 cover the exposed edges of channel 16, which can mitigate and/or prevent damage to the surface being cleaned and/or surfaces adjacent to the surface being cleaned (e.g., window sills).

In some embodiments, end caps 12 can maintain blade 18 in a taut or tensed condition within channel 16 so that the blade leaves the surface free of streaks during use.

End caps 12 are configured for easy, one hand operation and can be operated with the reduced hand dexterity present while wearing gloves. End caps 12 also advantageously allows blade 18 to be easily inserted into and removed from channel 16 without removing the channel from handle assembly 14.

Channel 16 can be made of any material suitable to withstand the forces exerted during normal operation of tool 10 and to withstand the cleaning chemicals normally associated with the use of such tools. For example, channel 16 can be made materials such as, but not limited to, molded polymeric material, die cast metallic materials, formed metallic materials, and extruded polymeric or metallic materials. In a preferred embodiment, channel 16 is made of extruded aluminum.

Figure 4:
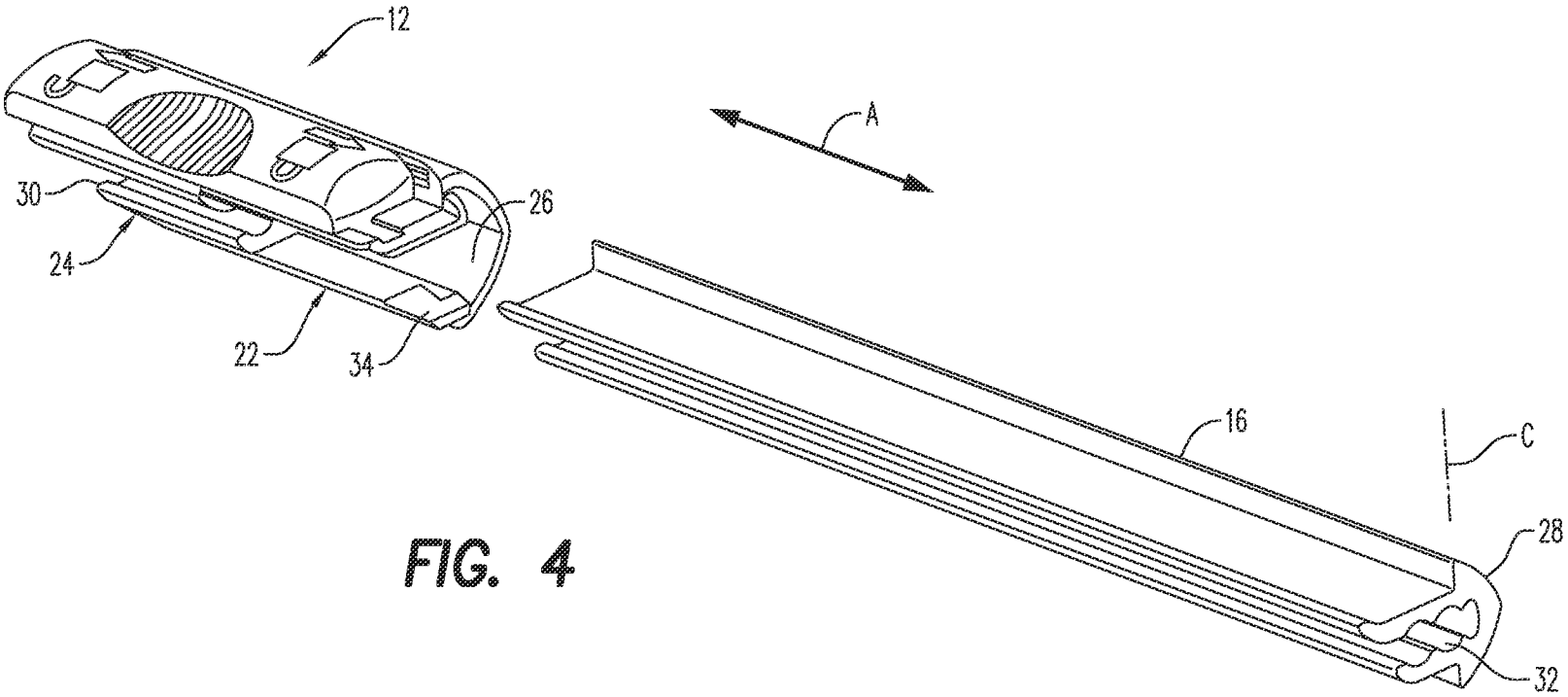
FIG. 4 is a rear perspective view of the end cap of FIG. 3 shown in an unlocked position, before assembly on the channel, and having the blade omitted for reasons of clarity.
Figure 5:
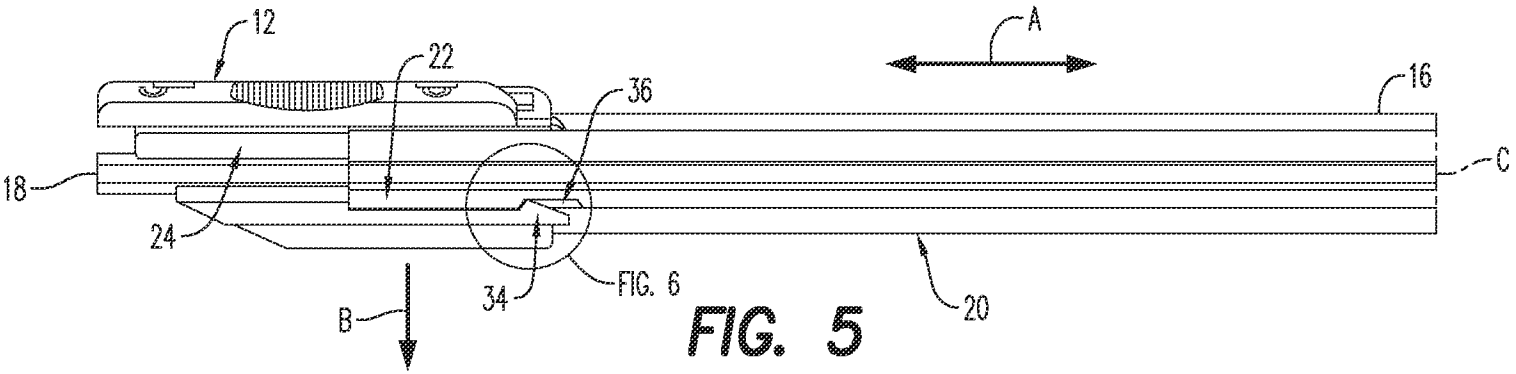
FIG. 5 is a rear view of the end cap of FIG. 4 shown in an unlocked position, after assembly on the channel, and having the blade omitted for reasons of clarity.

The interconnection of end caps 12 and channel 16 are described in detail with reference to FIGS. 4 through 6.

End caps 12 include an engagement region 22 that is configured to engage the end cap to channel 16 and an extension region 24 that extends axially from the engagement region. As used herein, the term "axial" shall refer to a direction along a longitudinal axis A of channel 16. Axial movement along axis A shall be referred to as being "inward" when the movement is towards a center C of channel 16 and is referred to as being "outward" when the movement is away from the center of the channel.

Engagement region 22 has an inner profile 26 sized to form a press-fit connection to an outer profile 28 of channel 16. In this manner, end caps 12 are secured to channel 16 by the press-fit connection between inner and outer profiles 26, 28. In addition, since end caps 12 fit over outer profile 28 of channel 16, the end caps advantageously protect the surface being cleaned from damage due to contact with edges of the channel.

Extension region 24 has an inner profile 30 that substantially matches an inner profile 32 of channel 16. Inner profiles 30, 32 are sized to slideably receive blade 18 therein. Preferably, inner profiles 30, 32 are slightly larger than the outer profile of blade 18 so that the blade can slide axially within channel assembly 20.

Extension region 24 axially extends outward from engagement region 22. It has been determined by the present disclosure that this configuration ensures that end caps 12 have a low profile, namely substantially match the outer dimension of channel 16, which allows the user to place the ends of blade 18 into tight corners present on many windows and other surfaces being cleaned and allows the user to hold tool 10 at different angles without contacting end caps 12 with the surface being cleaned.

In some embodiments, engagement region 22 can include a first locking member 34, while channel 16 includes a second locking member 36, which selectively engages to first locking member 34. In the illustrated embodiment, first locking member 34 is an upstanding tab having a cam surface 38 and a locking surface 40 and second locking member 36 is a cross-milled slot having a locking surface 42.

Figure 6:
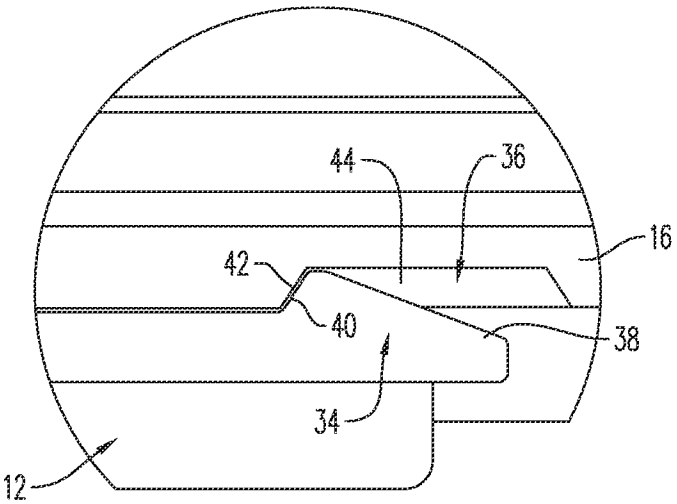
FIG. 6 is a magnified view of the end cap of FIG. 5.
Figure 6A:
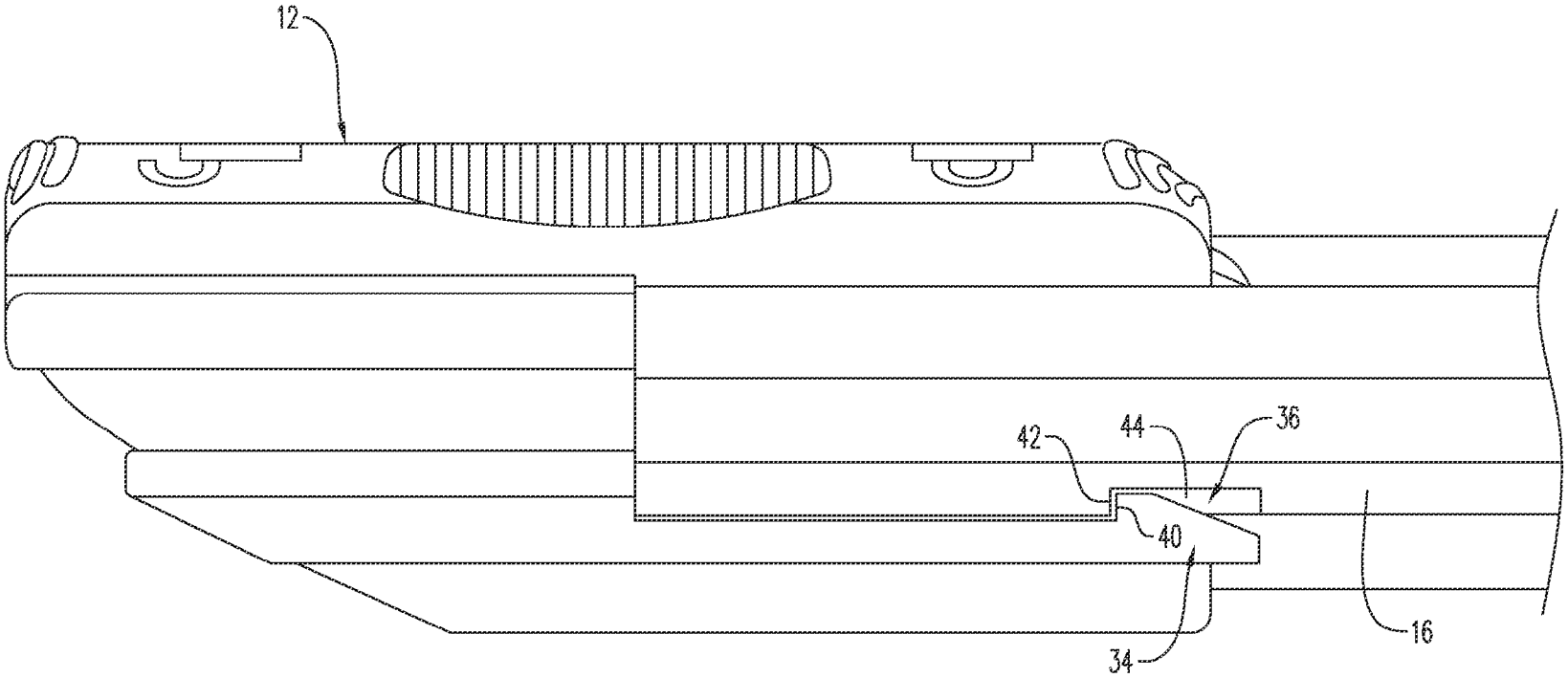
FIG. 6A is a magnified view of an alternate embodiment of the end cap of FIG. 5.

Locking surfaces 40, 42 can include a chamfer as shown in FIG. 6, or can be substantially vertical as shown in FIG. 6A. Of course, it is contemplated by the present disclosure for locking surfaces 40, 42 to have any shape sufficient to removably or permanently secure end cap 12 to channel 16.

During assembly of channel assembly 20, end cap 12 is slid inward along axis A over channel 16 so that inner profile 26 is received over outer profile 28. As end cap 12 is slid over channel 16, cam surface 38 acts on one or more portions of outer profile 28 to elastically deflect first locking member 34 in a perpendicular direction B. Once locking surface 40 reaches cross-milled slot 42, the natural resiliency of end cap 12 returns first locking member 34 to its normal position. In this position, locking surface 42 of the cross-milled slot interacts with locking surface 40 of the upstanding tab to prevent end cap 12 from being removed from channel 16. More specifically, interaction of locking surfaces 40, 42 prevent sliding of end cap 12 outward along the longitudinal axis A.

If it is desired to remove end cap 12 from channel 16, the operator must deflect first locking member 34 in perpendicular direction B until locking surface 40 is substantially free of interference from locking surface 42 and then slide the end cap outward along axis A. In the embodiment illustrated in FIGS. 6 and 6A, end cap 12 includes a gap 44 sufficient to receive a coin, screw-driver, or fingernail to allow the user to deflect first locking member 34.

It should be recognized that the engagement of end caps 12 and channel 16 are described above by way of example using both the press-fit engagement inner and outer profiles 26, 28 and the engagement of first and second locking members 34, 36. However, it is contemplated by the present disclosure for channel assembly to use either method of engagement individually or in combination with one another, as well as any other desired connection method.

Figure 7:
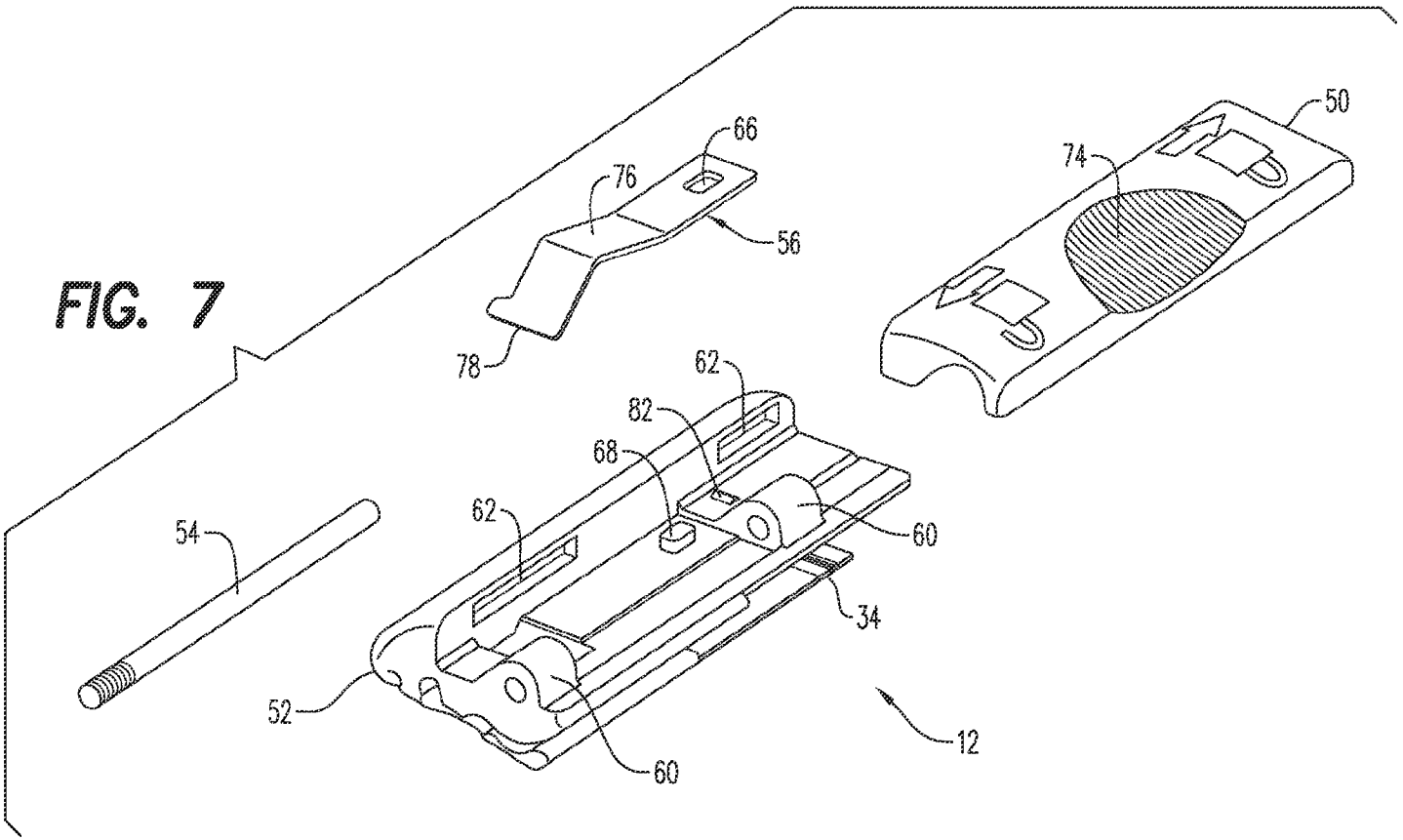
FIG. 7 is an exploded rear top perspective view of the end cap of FIG. 3.
Figure 8:
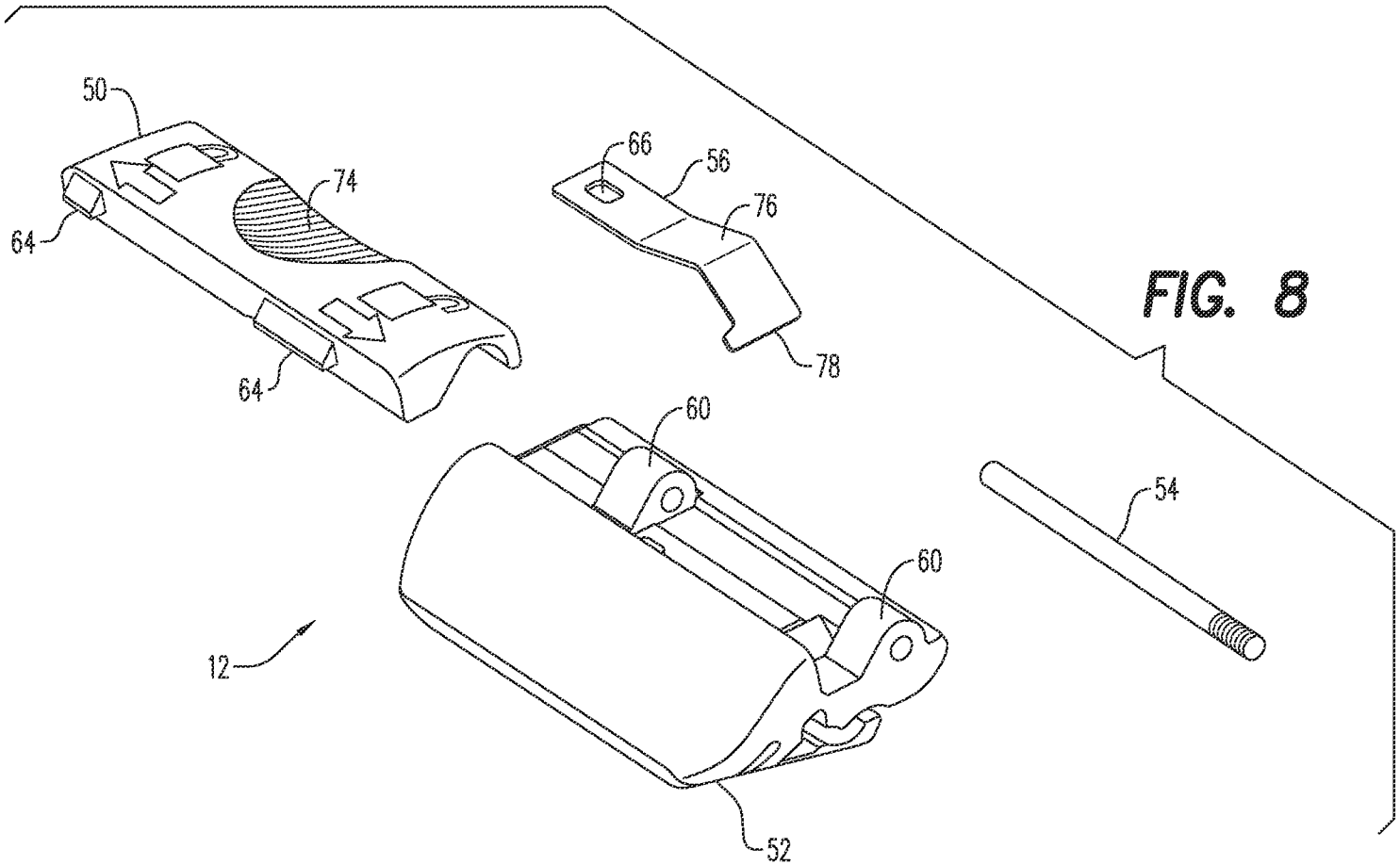
FIG. 8 is an exploded front top perspective view of the end cap of FIG. 3.
Figure 9:
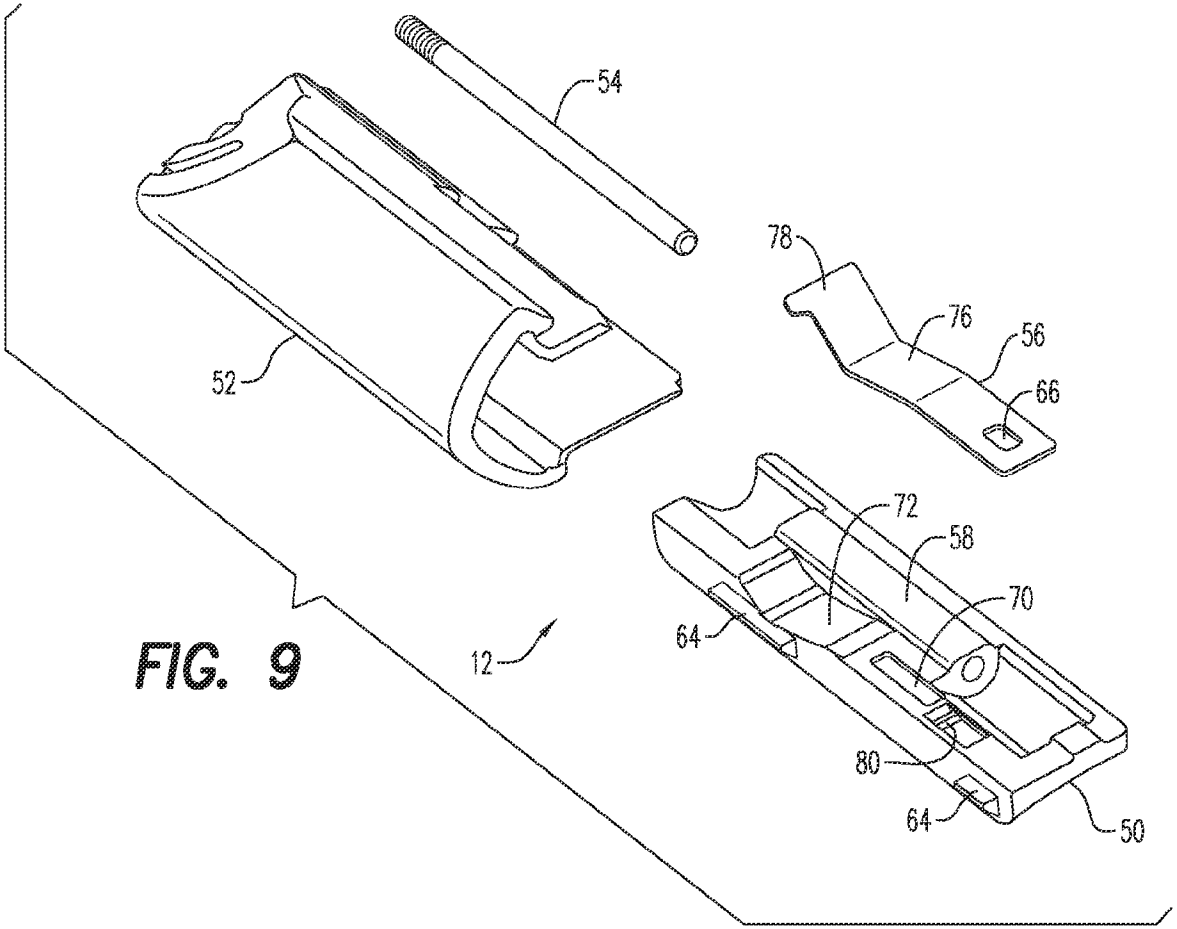
FIG. 9 is an exploded front bottom perspective view of the end cap of FIG. 3.

End caps 12 are described in more detail with reference to FIGS. 7 through 9. End caps 12 each have a movable portion 50, a stationary portion 52, a guide shaft 54, and a clamping member 56.

Movable portion 50 has one or more shaft bosses 58 (only one shown) and stationary portion 52 has one or more shaft bosses 60 (two shown). Movable and stationary portions 50, 52 are slidably connected to one another by the insertion of shaft 54 through bosses 58, 60. In addition, movable and stationary portions 50, 52 can further include complimentary guides 62 and 64, respectively, which extend along the longitudinal axis A.

Shaft 54, and when present guides 62, 64, secure movable portion 50 to stationary portion 52 such that the movable portion can slide along the longitudinal axis A between a locked position and an unlocked position as will be described in more detail herein below.

Clamping member 56 is secured between movable and stationary portions 50, 52. In the illustrated embodiment, clamping member 56 includes an aperture 66 that receives a guide 68 of stationary portion 52. When movable and stationary portions 50, 52 are connected, guide 68 passes through aperture 66 and is received in a complimentary guide 70 of movable portion 50.

Aperture 66 is substantially the same size as guide 68 of stationary portion 52, while guide 70 is elongated along the longitudinal axis A. In this manner, clamping member 56 remains substantially stationary or fixed with respect to stationary member 52 when movable portion 50 is moved between the locked and unlocked positions.

Of course, it should be recognized that the present disclosure contemplates end cap 12 have clamping member 56 affixed to stationary member 52 by any desired method such as, but not limited to, adhesive, weld, interference fit, and others.

For reasons described in more detail below, movable portion 50 includes a cam surface 72 that engages clamping member 56 as the movable portion is moved from the unlocked position to the locked position. Clamping member 56 can, in some embodiments, be made of a resilient material such as, but not limited to, spring steel and includes, when in its normal, unbiased state, a bent region 76 defined therein.

Cam surface 72 influences clamping member 56 when movable portion 50 is in the locked position such that the cam surface resiliently flexes the clamping member. Conversely, cam surface 72 does not significantly affect clamping member 56 when movable portion 50 is in the unlocked position such that the natural resiliency of the member returns bent region 76 to its normal, unbiased state. It should be recognized that clamping member 56 can remain in a partially biased state when movable portion 50 is in the unlocked position provided that free end 78 is sufficiently disengaged from blade 18.

Stated another way, movement of movable portion 50 to the locked position resiliently flexes clamping member 56 so that a free end 78 of the clamping member moves approximately perpendicular to longitudinal axis A due to cam surface 72 acting on and flexing bent region 76. Flexion of clamping member 56 continues until free end 78 moves into contact with and compresses blade 18 against channel 16 to secure the blade within the channel.

Conversely, movement of movable portion 50 to the unlocked position allows clamping member 56 to return bent region 76 to its normal, unbiased state such that free end 78 is out of contact with blade 18, which allows blade 18 to be easily moved with respect to channel 16.

In some embodiments, end caps 12 can also be configured to force blade 18 to a taut or tensed condition within channel 16. Here, in its normal, unbiased state, bent region 76 has the effect of providing tensioning member 56 with a shorten length along the longitudinal axis A. However, when in the biased state, bent region 76 is straightened to provide clamping member 56 with longer length along the longitudinal axis A then when in its unbiased state.

Stated another way, movement of movable portion 50 to the locked position resiliently flexes clamping member 56 so that free end 78 of the clamping member moves outward along longitudinal axis A due to cam surface 72 acting on and flexing bent region 76. Flexion of clamping member 56 continues until free end 78 moves into contact with and urges blade 18 axially outward while the free end is moving against channel 16 to secure the blade within the channel.

Conversely, movement of movable portion 50 to the unlocked position allows clamping member 56 to return bent region 76 to its normal, unbiased state such that free end 78 is out of contact with blade 18, which allows blade 18 to be easily moved with respect to channel 16.

Further, the user can advantageously pull blade 18 into a tensed or taut state even with end caps 12 in the locked position. For example, clamping member 56, when in the locked position, due to the angle with which free end 78 contacts blade 18, prevents movement of the blade axially inwardly, while allowing movement axially outward. Thus, when a user applies a force on the exposed ends of blade 18 in the axially outward direction, the outer portion of the blade can slide with respect to free end 78.

More specifically, when in the locked position, free end 78 has an angle β with respect to axis A that is between about 90 degrees and less than about 180 degrees, with between about 110 degrees to about 160 degrees being preferred, and any subranges therebetween. In this manner, clamping member 56 provides free end 78 with a "wedging action" with respect to blade 18 to resist movement of blade axially inward, but provides the free end with a "non-wedging" action to allow movement of blade axially outward.

Thus, end caps 12 can be configured to tense blade 18 before movement of movable portion 50 then held in the tensed condition once the movable portion is in the locked position. End caps 12 can be configured to tense blade 18 during movement of movable portion 50 to the locked position. Further, end caps 12 can be configured so that the user can tense blade 18 after movable portion 50 is moved to the locked position.

The clamping function, and when present the blade tensioning function, of end caps 12 is described in more detail with reference to FIGS. 10 through 14.

When movable portion 50 is in the unlocked position (FIGS. 10 and 11), clamping member 56 is unaffected by cam surface 72 so that bent region 76 is in its normal, unbiased state. With bent region 76 is the normal, unbiased state, clamping member 56 has a free end 78 that is spaced apart from and disengaged from blade 18. Conversely, when movable portion 50 is in the locked position (FIGS. 12 through 14), clamping member 56 is affected by cam surface 72 such that the clamping member resiliently flexes bent region 76 until free end 78 is in contact with blade 18.

Figure 11:
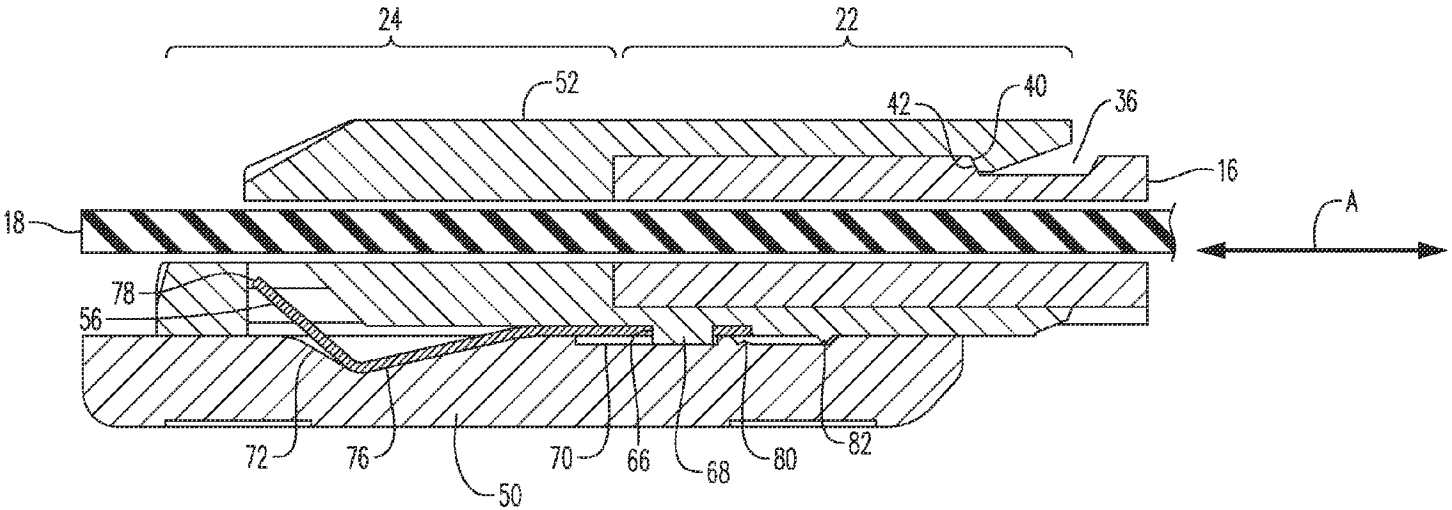
FIG. 11 is a sectional view of the channel assembly taken along lines 11-11 in FIG. 10.

As seen in FIG. 11, free end 78 is positioned within extension region 24 of end cap 12. Thus, free end 78 is axially outward from engagement region 22. In this manner, end caps 12 not only secure blade 18 in channel 16 and, when present, tenses the blade within the channel, but also provide the low profile that allows the user to place the ends of the blade into tight corners.

Movement of movable portion 50 inward along axis A (e.g., to the right in FIGS. 11 and 13) from the unlocked position to the locked position, results in cam surface 72 acting on and flexing bent region 76, which in turn flexes clamping member 56 perpendicular to longitudinal axis A (e.g., upward in FIGS. 11 and 13) such that free end 78 moves into contact with blade 18 and compresses the blade against channel 16.

Channel assembly 20 includes end cap 12 at opposite ends of blade 18. Since each end cap 12, when in the locked position, has free end 78 in contact with and compressing blade 18 against channel 16, the end caps advantageously ensure that the blade does not wander or move within the channel during use.

Further, the user can advantageously pull blade 18 into a tensed or taut state even with end caps 12 in the locked position. For example, clamping member 56, when in the locked position, due to the angle with which free end 78 contacts blade 18, substantially prevents movement of the blade axially inwardly, while allowing movement axially outward. Thus, when a user applies a sufficient force on the exposed ends of blade 18 in the axially outward direction, the outer portion of the blade can slide with respect to free end 78.

In the embodiments where end cap 12 also includes the aforementioned tensioning function, movement of movable portion 50 inward along axis A (e.g., to the right in FIGS. 11 and 13) from the unlocked position to the locked position, results in cam surface 72 acting on and flexing bent region 76 to elongate clamping member 56 outward along the longitudinal axis A (e.g., to the left in FIGS. 11 and 13) such that free end 78 moves into contact with and biases blade 18 outward.

In this embodiment, end cap 12, when in the locked position, has free end 78 in contact with and outwardly biasing blade 18, the end caps advantageously push the blade in opposite directions along longitudinal axis A to place the blade in a taut or tensed condition within channel 16 so that the blade leaves the surface free of streaks during use.

Movement of movable portion 50 outward along axis A (e.g., to the left in FIGS. 11 and 13) from the locked position to the unlocked position, results in bent region 76 returning to its unbiased state in which free end 78 is spaced apart from and disengaged from blade 18. In this manner, end caps 12 also advantageously allows blade 18 to be easily inserted into and removed from channel 16 without removing the channel from handle assembly 14.

Figure 3A:
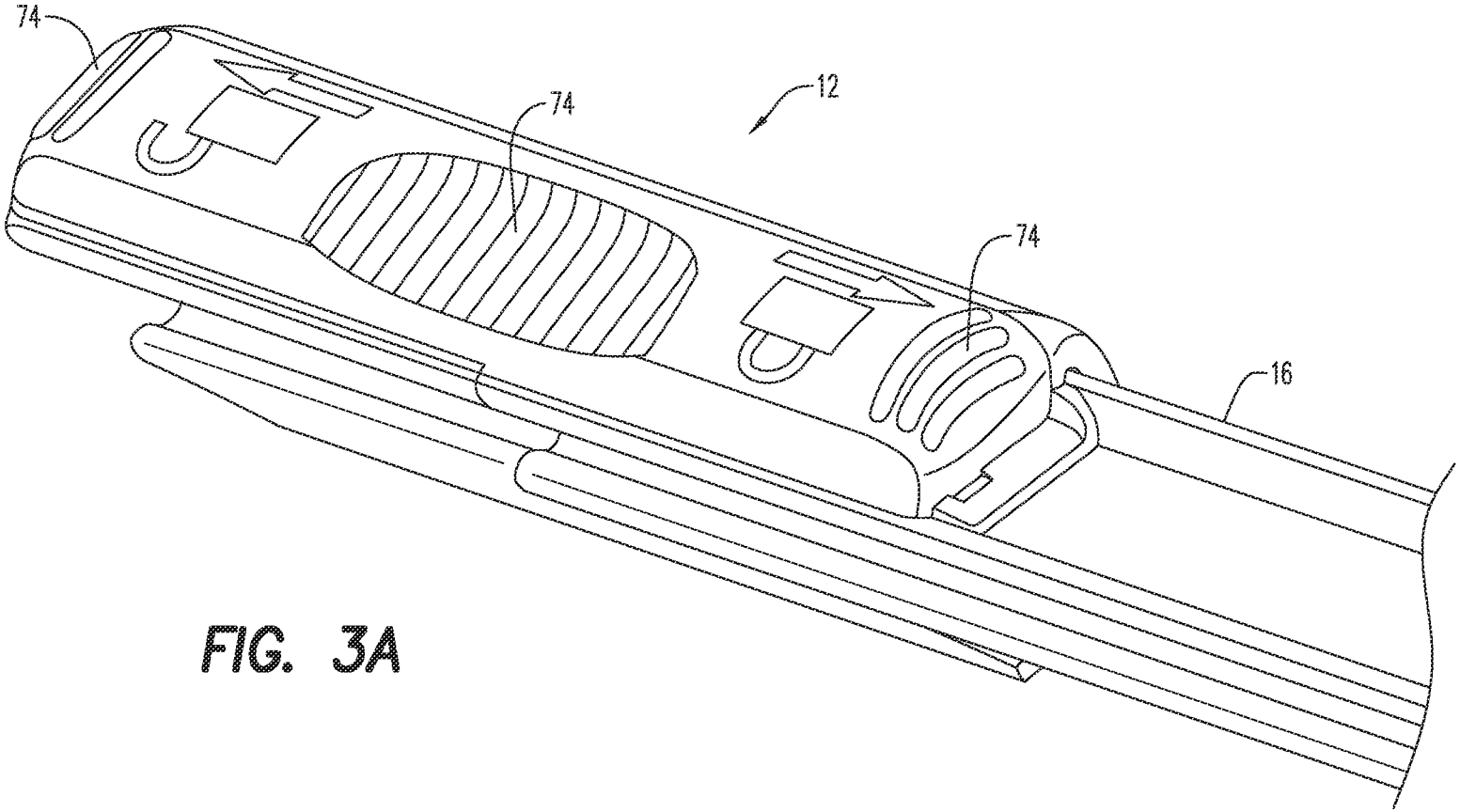
FIG. 3A is a magnified view of an alternate exemplary embodiment of the end cap of the channel assembly of FIG. 2.

End caps 12 are configured for easy, one hand operation and can be moved between the locked and unlocked positions with the reduced hand dexterity present while wearing gloves. For example, in some embodiments, movable portion 50 can include one or more gripping areas such as gripping areas 74 of FIGS. 3 and 3A that the user can, with one hand, both grip channel 16 and exert forces on the movable portion.

Returning now to FIGS. 7 through 9, end caps 12 can, in some embodiments, also include complimentary locking members 80, 82 on movable and stationary portions 50, 52, respectively. Locking members 80, 82 are configured to selectively hold movable portion 50 in the locked position.

Specifically, movable portion 50 includes locking member 80, while stationary member 52 includes locking member 82. Locking members 80, 82 are positioned such that the members are engaged with one another when movable portion 50 is in the locked position, but are disengaged from one another when the movable portion is in the unlocked position.

The locking function of locking members 80, 82 is described in more detail with reference again to FIGS. 10 through 13.

Figure 10:
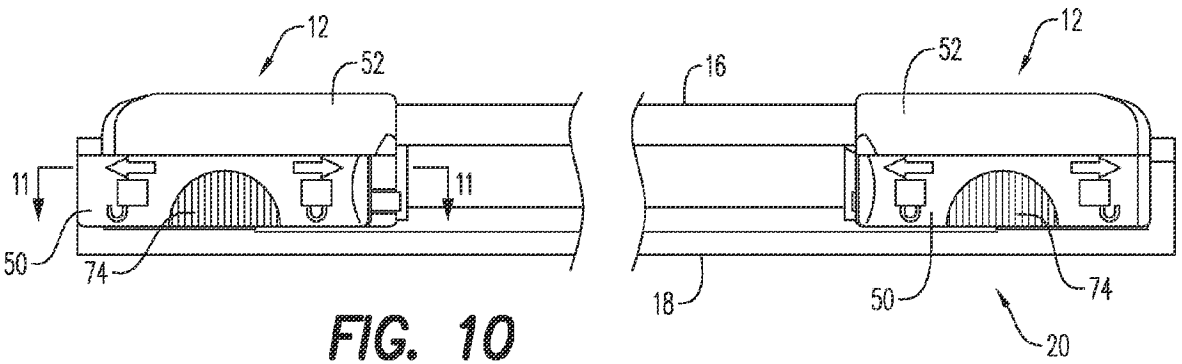
FIG. 10 is top view of the channel assembly of FIG. 3 having one end cap in the unlocked position and the other in the locked position.
Figure 12:
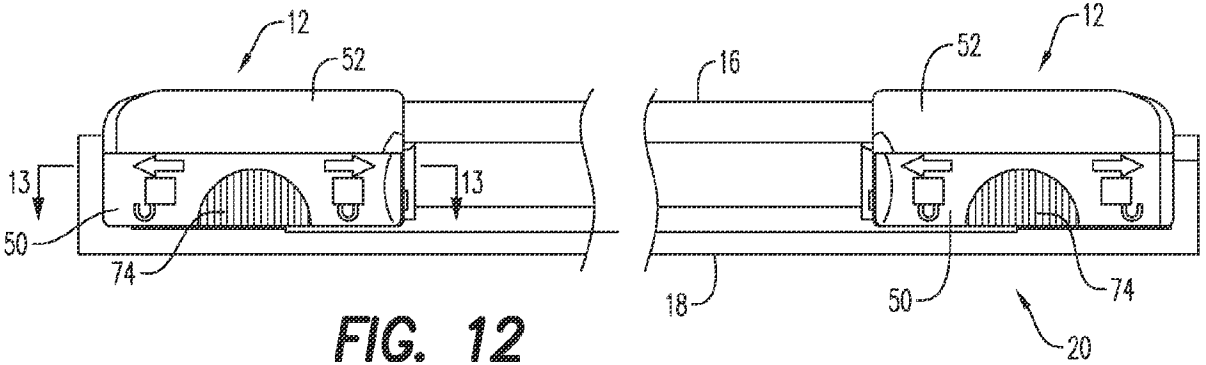
FIG. 12 is top view of the channel assembly of FIG. 3 having one end cap in the unlocked position and the other in the locked position.
Figure 13:
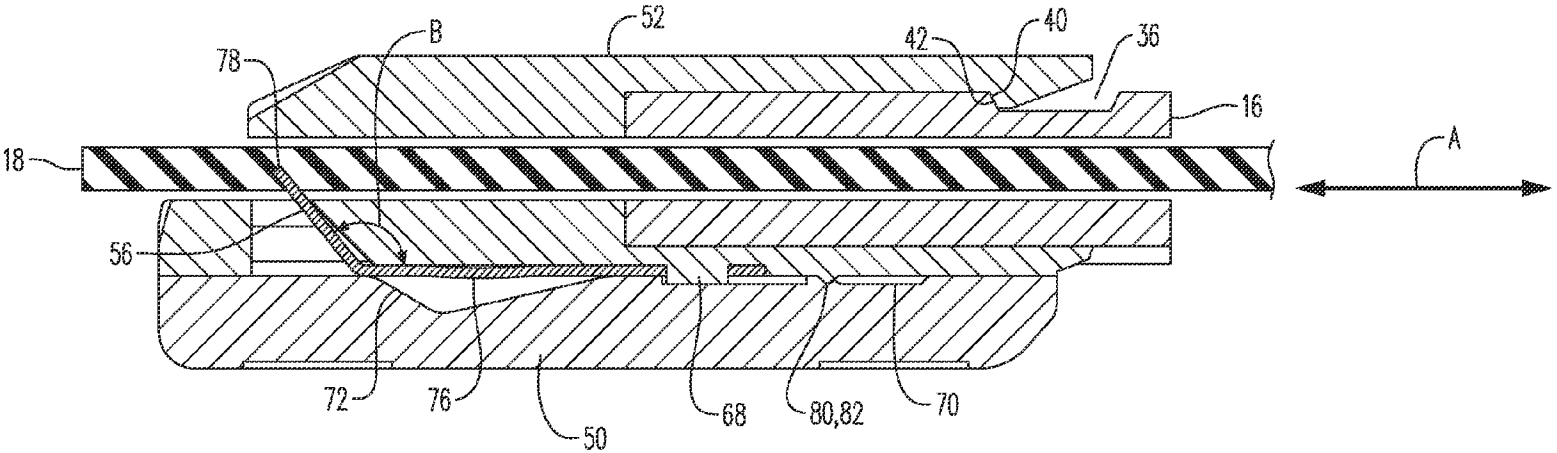
FIG. 13 is a sectional view of the channel assembly taken along lines 13-13 in FIG. 12.

Movable portion 50 is shown in the unlocked position in FIGS. 10 and 11, and in the locked position in FIGS. 12 and 13. As best seen in FIG. 11, when movable portion 50 is in the unlocked position, locking member 80 is disengaged from locking member 82. However, as best seen in FIG. 13, when movable portion 50 is in the locked position, locking member 80 is engaged with locking member 82 to maintain the movable portion in the locked position.

End caps 12 can be made of any material suitable to withstand the forces exerted during normal operation of tool 10, to withstand the cleaning chemicals normally associated with the use of such tools, and to provide sufficient elasticity to allow for the flexion of locking members 34, 80, and 82. For example, end caps 12 can be made materials such as, but not limited to, molded polymeric materials including acetal, nylon, polycarbonate, and others. Further, it is contemplated by the present disclosure for movable and stationary portions 50, 52 of end caps 12 to be made of the same materials or different materials.

It should be recognized that end caps 12 are described by way of example only being locked by inward movement along longitudinal axis A and unlocked by outward movement along the longitudinal axis. Of course, it is contemplated by the present disclosure for end caps 12 to be configured to be locked by outward movement along longitudinal axis A and unlocked by inward movement along the longitudinal axis.

Figure 15:
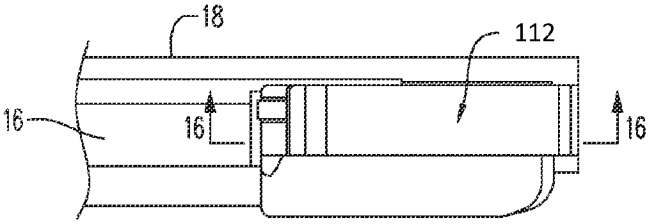
FIG. 15 is a top view of an alternate exemplary embodiment of the end caps according to the present disclosure.
Figure 16:
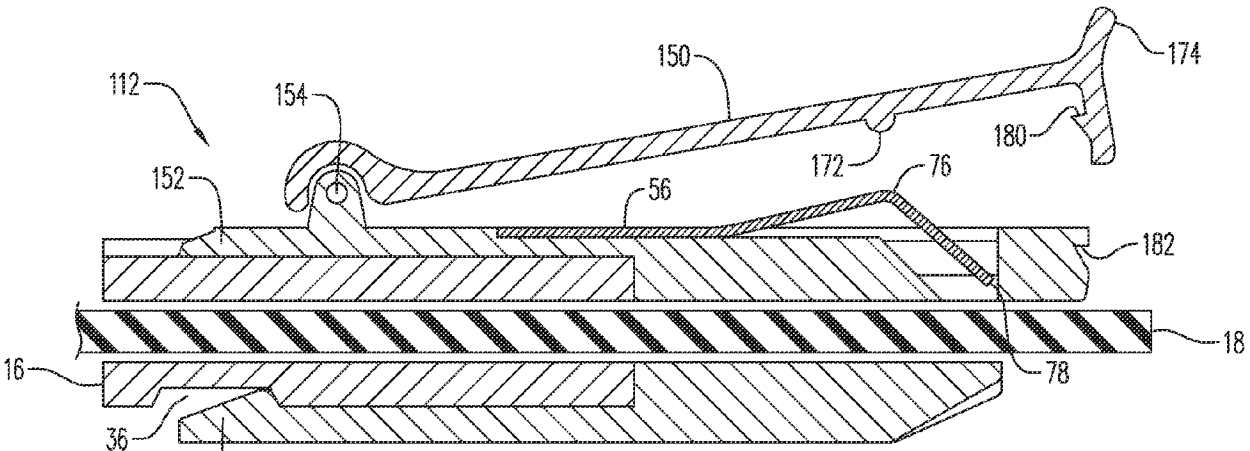
FIG. 16 is a sectional view of the channel assembly of FIG. 15 taken along lines 16-16, with the end cap shown in the unlocked position.
Figure 14:
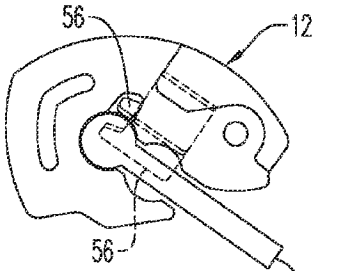
FIG. 14 is an end view of the channel assembly of FIG. 3 having one end cap in the unlocked position and the other in the locked position.

Moreover, it is contemplated by the present disclosure for end caps 12 to be moved between the locked and unlocked position by a rotation of movable member 52. For example, and with reference to FIGS. 15 through 17, an alternate exemplary embodiment of end caps 112 (only one shown) according to the present disclosure are shown.

End caps 112 each have a movable portion 150, a stationary portion 152, a guide shaft 154, and a clamping member 56. Clamping member 56 functions as described above with respect to end cap 12.

Figure 17:
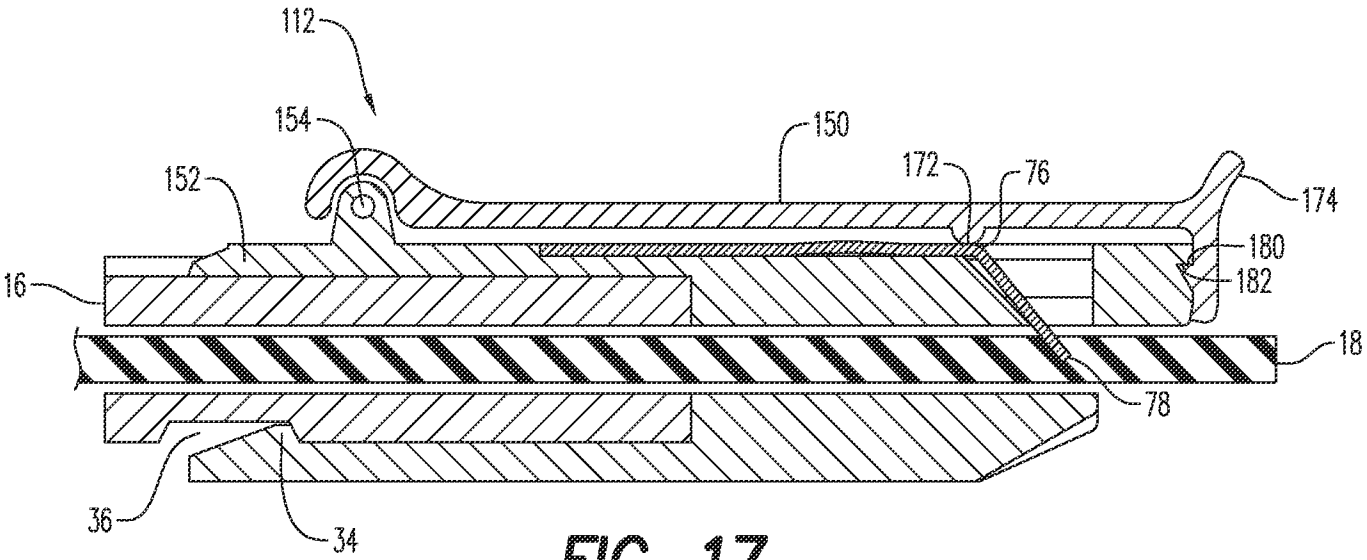
FIG. 17 is a sectional view of the channel assembly of FIG. 15 taken along lines 16-16, with the end cap shown in the locked position.

Movable portion 150 is rotatably connected to stationary portion 152 by guide shaft 154. In this manner, movable portion 150 can be moved between an unlocked position (FIG. 16) and a locked position (FIG. 17).

Movable portion 150 includes a cam surface 172 that engages clamping member 56 as the movable portion is moved from the unlocked position to the locked position and disengages the clamping member as the movable portion is moved from the locked position to the unlocked position.

End caps 112 can, in some embodiments, also include complimentary locking members 180, 182 on movable and stationary portions 150, 152, respectively. Locking members 180, 182 are configured to selectively hold movable portion 150 in the locked position.

End caps 112 are configured for easy, one hand operation and can be moved between the locked and unlocked positions with the reduced hand dexterity present while wearing gloves. For example, in some embodiments, movable portion 150 can include one or more gripping areas such as gripping areas 174 for exerting forces on the movable portion sufficient to move the movable portion between the locked and unlocked positions.

During assembly, end caps 112 include first locking member 34, while channel 16 includes second locking member 36, which selectively engages to first locking member 34 in the manner described above with respect to end cap 12. Of course, it is contemplated by the present disclosure for first and second locking members 34, 36 to have any shape sufficient to removably or permanently secure end caps 112 to channel 16.

Accordingly, end caps 112 can be used to secure blade 18 in channel 16, and when clamping member 56 is sufficiently configured, to maintain the blade taut within the channel by rotating the movable portion 150 between the unlocked and locked positions.

Figure 18:
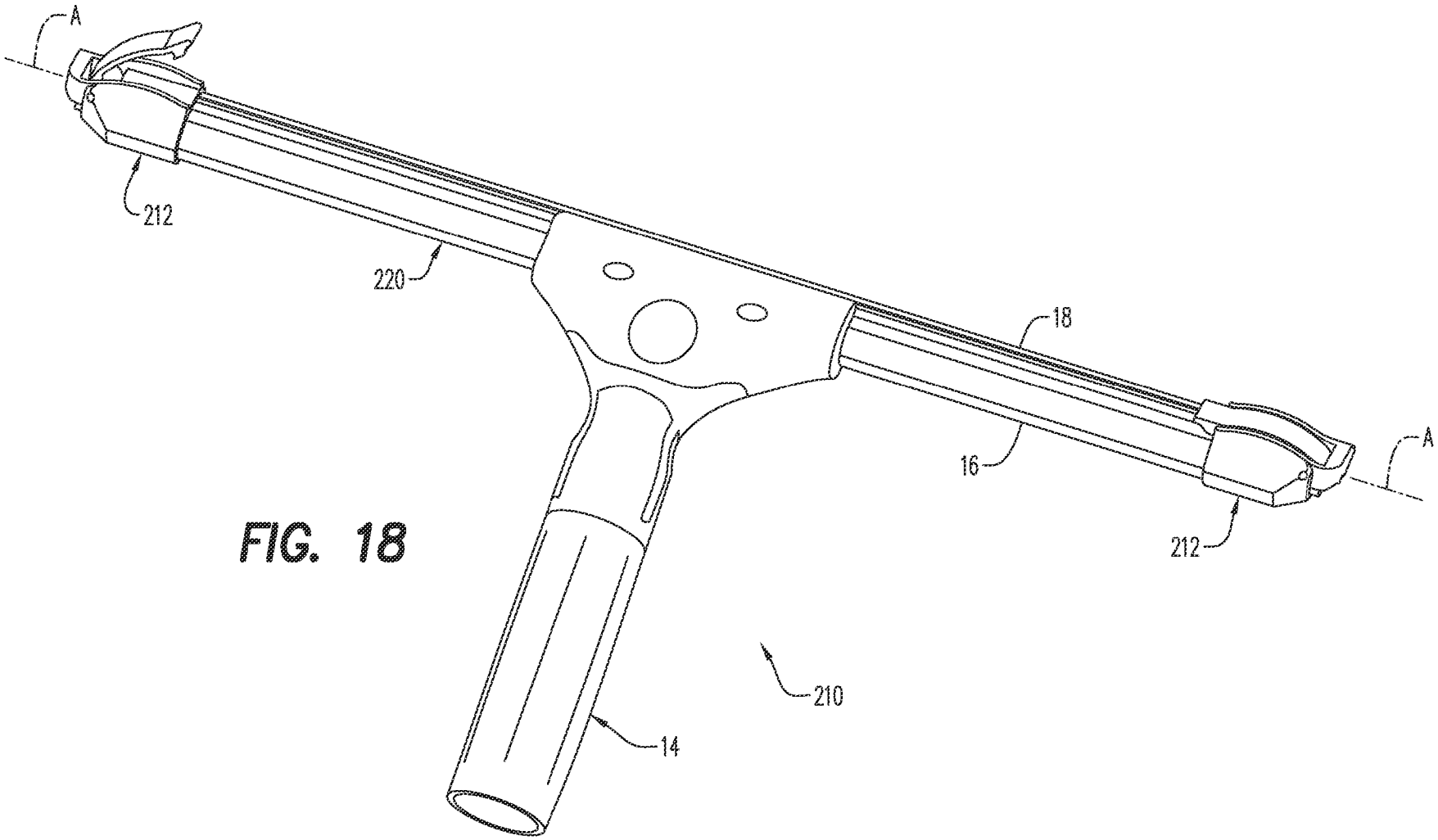
FIG. 18 is front perspective view of an exemplary embodiment of a surface cleaning tool according to the present disclosure.
Figure 19:
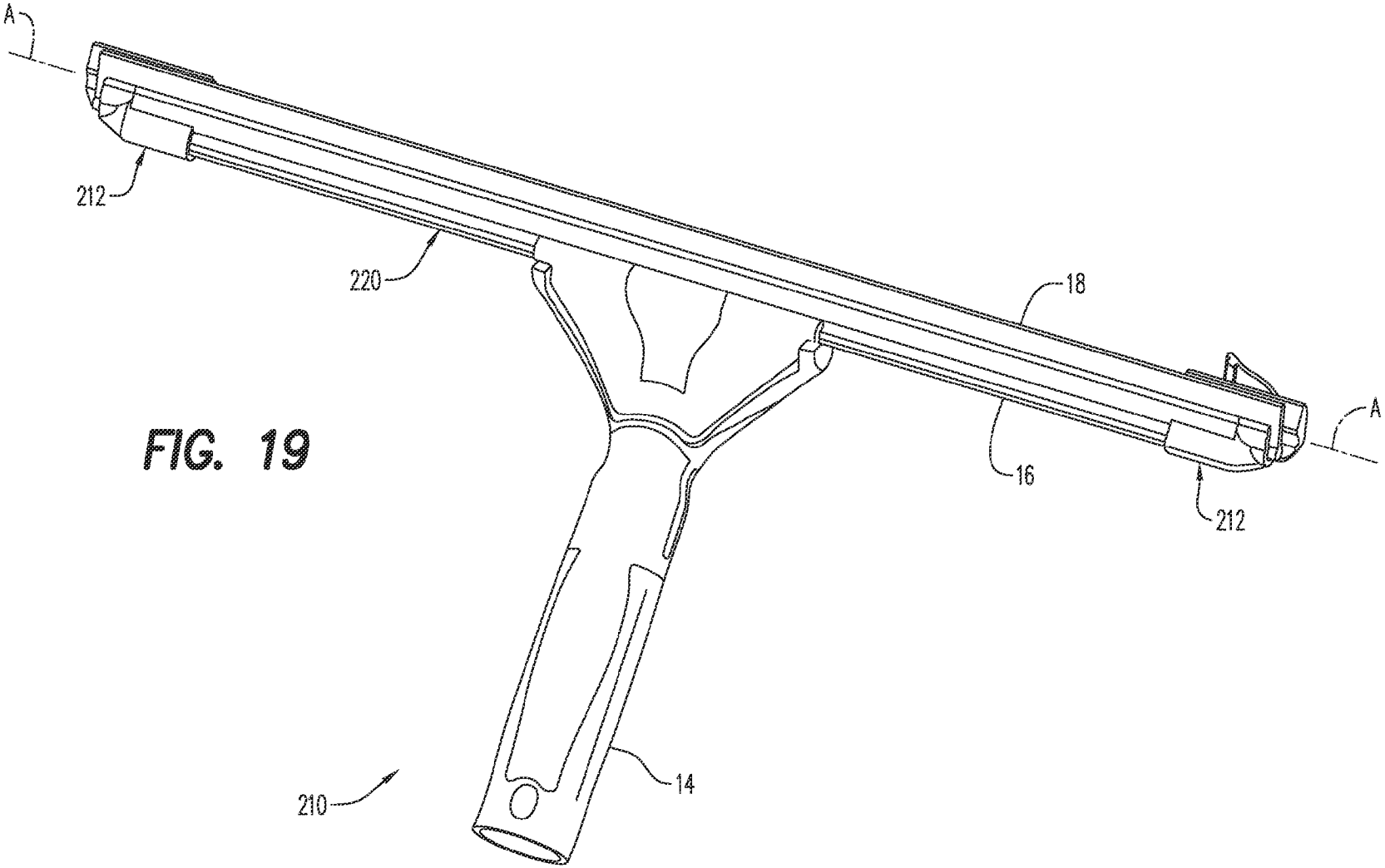
FIG. 19 is a rear perspective view of the tool of FIG. 18.
Figure 20:
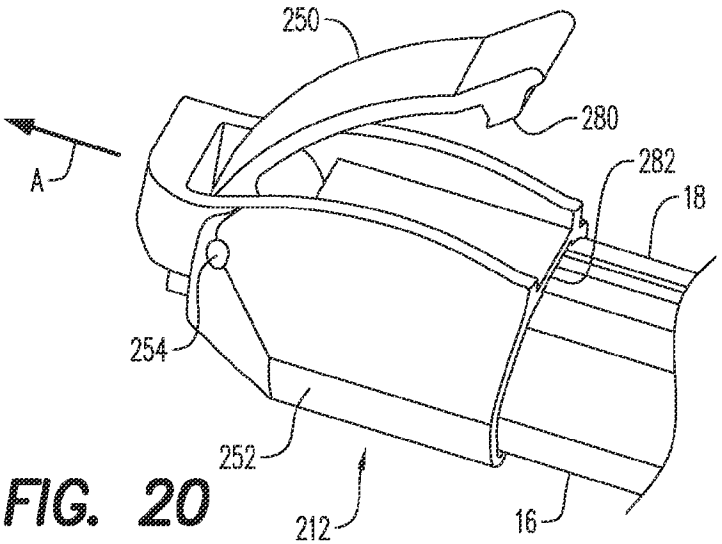
FIG. 20 is a front perspective view of an exemplary embodiment of a blade clamping member for use with the tool in FIG. 18 shown in an open or unlocked position.
Figure 21:
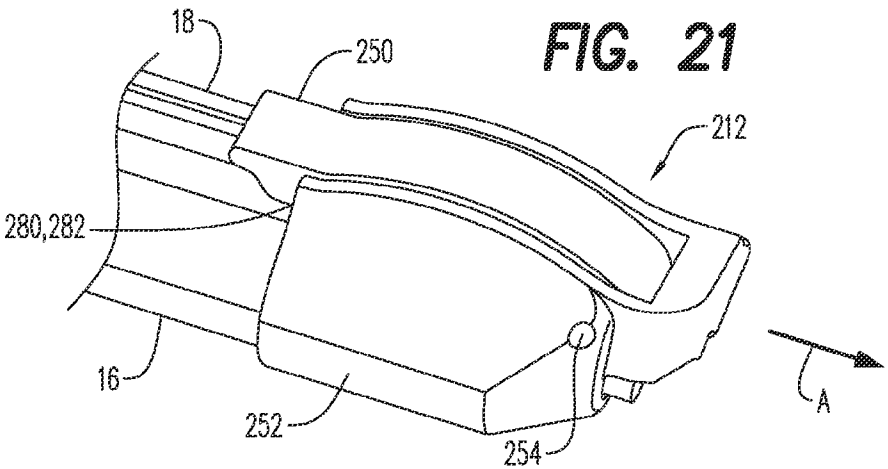
FIG. 21 is a front perspective view of the blade clamping member of FIG. 20 shown in a closed or locked position.

Referring now to FIGS. 18 and 19, another alternate exemplary embodiment of surface cleaning tool 210 according to the present disclosure is shown. Tool 210 includes a pair of end caps 212, a handle assembly 14, a rigid channel 16, and a wiper blade 18.

End caps 212, channel 16, and blade 18, when assembled together form a channel assembly 220, which can be secured to handle assembly 14. In this manner, tool 210 is configured to move blade 18 along a surface such as, but not limited to, glass windows, glass mirrors, counters, griddles, shower walls, and other flat surfaces to wipe away debris, water, cleaning fluid and other materials from the surface.

End caps 212 advantageously allow blade 18 to be assembled with and removed from rigid channel 16 without removing the channel from handle assembly 14.

End caps 212 are described in more detail with simultaneous reference to FIGS. 18 through 27. End caps 212 are movable between an unlocked position shown in FIGS. 18, 20, 22, and 24, and a locked position shown in FIGS. 19, 21, 23, and 25.

In the unlocked position, end caps 212 are configured so that blade 18 can be removed from channel 16 by sliding the wiper blade along a longitudinal axis A of the channel. In the locked position, end caps 212 are configured to prevent blade 18 from sliding in channel 16 along longitudinal axis A. Moreover, end caps 212, when in the locked position, are advantageously configured to pull blade 18 in opposite directions along longitudinal axis A to place the blade in a taut or tensed condition.

End caps 212 include a movable portion 250, a stationary portion 252, and a guide shaft 254. Movable portion 250 is movably secured to stationary portion 252 by shaft 254 for movement between the locked and unlocked positions. Of course, it is contemplated by the present disclosure for movable portion 250 to be secured to stationary portion 252 in any desired manner sufficient to allow the movable portion to move between the locked and unlocked positions. For example, in some embodiments of end caps 212, shaft 254 can be replaced by a living hinge between movable and stationary portions 250, 252.

The free end of movable portion 250 is releasably secured or locked to stationary portion 252 when in the locked position. In the illustrated embodiment, movable and stationary portions 250, 252 can include complimentary locking members 280, 282 on movable and stationary portions 250, 252, respectively. Locking members 280, 282 are configured to selectively hold movable portion 250 in the locked position. Of course, it is contemplated by the present disclosure for movable portion 250 to be selectively locked to stationary portion 252 in any desired manner.

Stationary portion 250 is configured to fit over an outer periphery of channel 16 in the manner described above with respect to end cap 12. In some embodiments, end cap 212 forms a press fit engagement with the outer periphery of channel 16. However, it is contemplated by the present disclosure for end cap 212 to be removably or permanently secured to channel 16 in any desired manner. In this manner, end caps 212 can be easily replaced in the event of damage.

Movable portion 250 further includes one or more clamping members 256. In this embodiment, clamping members 256 are affixed to or remain stationary on movable portion 250. Clamping members 256 include a free end 278, which engages with and disengages from blade 18, when movable portion 250 is moved between the locked and unlocked positions, respectively.

Figure 22:
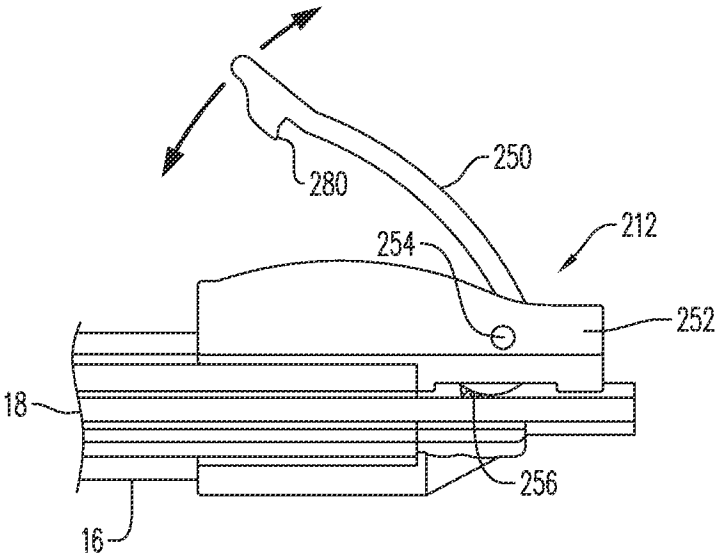
FIG. 22 is a magnified front view of the blade clamping member of FIG. 20, shown in the open or unlocked position.
Figure 24:
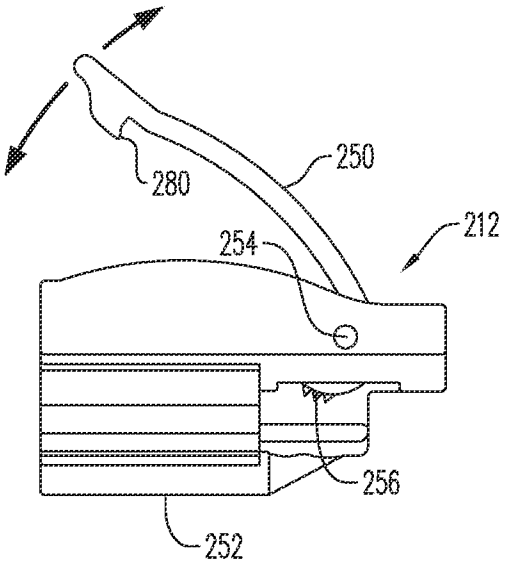
FIG. 24 is a view of the blade clamping member of FIG. 22 having the channel and wiper blade omitted.

As best seen in FIGS. 22 and 24, movable portion 250, when in the unlocked position, is configured so that free ends 278 of clamping members 256 are spaced a predetermined distance from channel 16 to provide a passageway to allow blade 18 to be removed from or placed into the channel by sliding the blade along longitudinal axis A.

Figure 23:
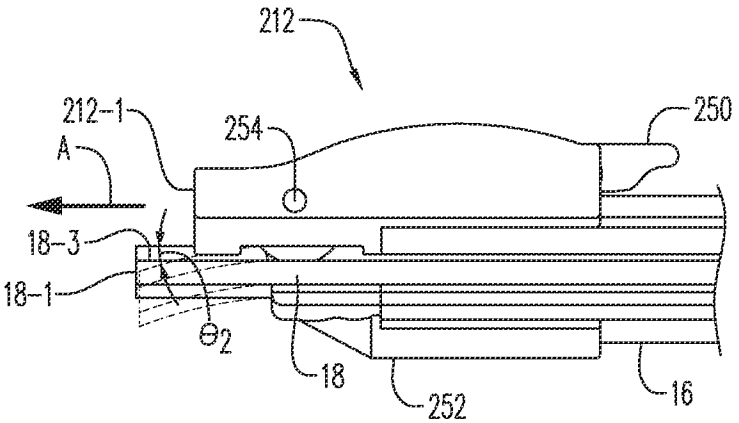
FIG. 23 is a magnified front view of the blade clamping member of FIG. 21, shown in the closed or locked position.
Figure 25:
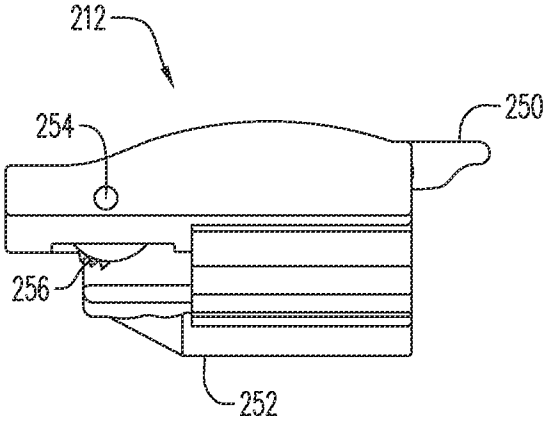
FIG. 25 is a view of the blade clamping member of FIG. 23 having the channel and wiper blade omitted.
Figure 26:
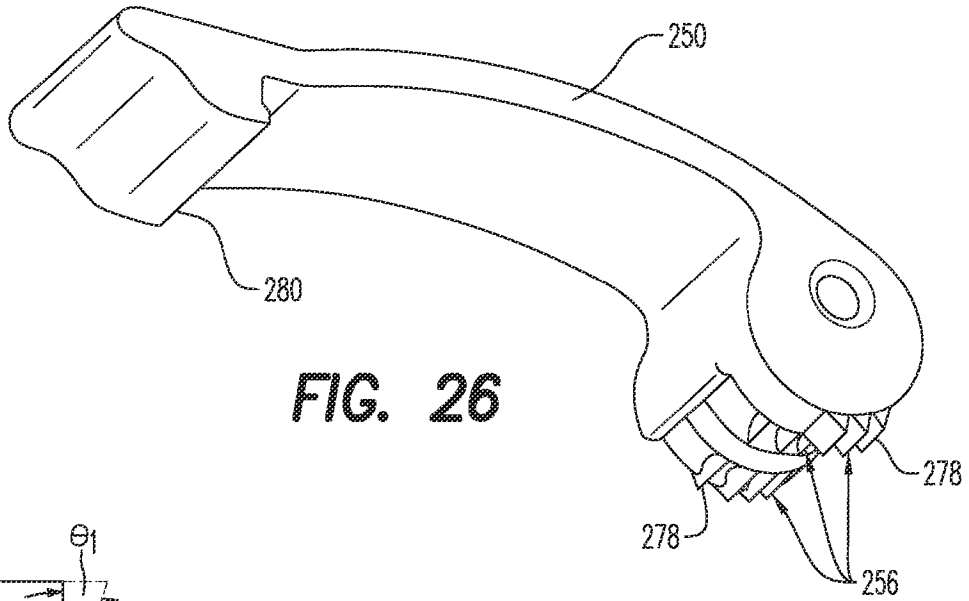
FIG. 26 is a perspective view of an exemplary embodiment of a lever arm for use with the blade clamping member of the present disclosure.

However, as best seen in FIGS. 23 and 25, movable portion 250, when in the locked position, is configured so that free ends 278 of clamping members 256 are in contact with blade 18 so that the wiper blade cannot be moved with respect to channel 16 along longitudinal axis A. Stated another way, free ends 278 compress blade 18 against channel 16 so that the blade is secured in the channel.

Advantageously, the contact between clamping members 256 and wiper blade 18 also acts to apply tension to blade 18 along longitudinal axis A so that end caps 212 act in opposite directions on the blade to place the blade in a taut or tensed condition.

Movable portion 250 can include clamping members 256 in any desired pattern and/or shape sufficient to provide tension to blade 18. For example, in the embodiment shown in FIG. 26, movable portion 250 includes three or more rows of clamping members 256 of varying heights so that the clamping members 256 conform to the height of blade 18.

Figure 27:
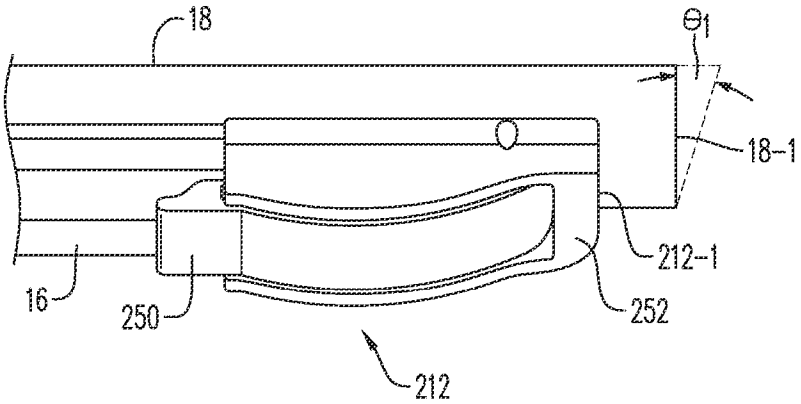
FIG. 27 is a top view of the blade clamping member in a locked position illustrating the resultant position of the wiper blade.

As shown in FIG. 27, blade 18 can be positioned in end caps 212 so that a terminal end 18-1 of the blade extends at least to, and preferably beyond, a terminal end 212-1 of the end cap. In this manner, blade 18 can be used to clean sharp corners or edges of the surface being cleaned, such as a window frame.

Advantageously, clamping members 256 are configured so that, when in the locked position, terminal end 18-1 of blade 18 is at least parallel to terminal end 212-1 of end cap 212. In some embodiments, clamping members 256 are configured so that, when in the locked position, terminal end 18-1 of blade 18 forms a first angle $\theta_1$ with respect to terminal end 212-1 of end cap 212 as illustrated in phantom. It is contemplated by the present disclosure for first angle $\theta_1$ to be more than 0 degrees and less than about 30 degrees, with between about 5 degrees to about 15 degrees being preferred, and any subranges therebetween.

Furthermore, and referring to FIG. 23, end cap 212 is configured so that, when in the locked position, blade 18 has a portion 18-3 that extends past terminal end 212-1 of end cap 212 remains substantially parallel to longitudinal axis A. In some embodiments, end cap 212 is configured so that, when in the locked position, portion 18-3 of blade 18 forms a second angle $\theta_2$ with respect to longitudinal axis A as illustrated in phantom. It is contemplated by the present disclosure for second angle $\theta_2$ to be more than 0 degrees and less than about 30 degrees, with between about 5 degrees to about 15 degrees being preferred, and any subranges therebetween.

It has been determined by the present disclosure that angles $\theta_1$ and $\theta_2$ ensure that blade 18 can be positioned to reach into tight corners. Thus, it has been determined by the present disclosure that the shape and position of clamping members 56 can also be used to define the shape and position of terminal end 18-1 and portion 18-3 with respect to end cap 212.

It should be recognized that clamping members 256 are shown by way of example only as teeth extending from movable portion 250. Of course, it is contemplated by the present disclosure for movable portion 250 to include any clamping member 256 sufficient to define the shape and position of blade 18.

Movable and stationary portions 250, 252 can be made of any material suitable to withstand the forces exerted during normal operation of tool 10. For example, end movable and stationary portions 250, 252 can be made materials such as, but not limited to, molded polymeric material or die cast metallic materials. Further, movable and stationary portions 250, 252 can be made of the same materials or different materials.

Figure 28:
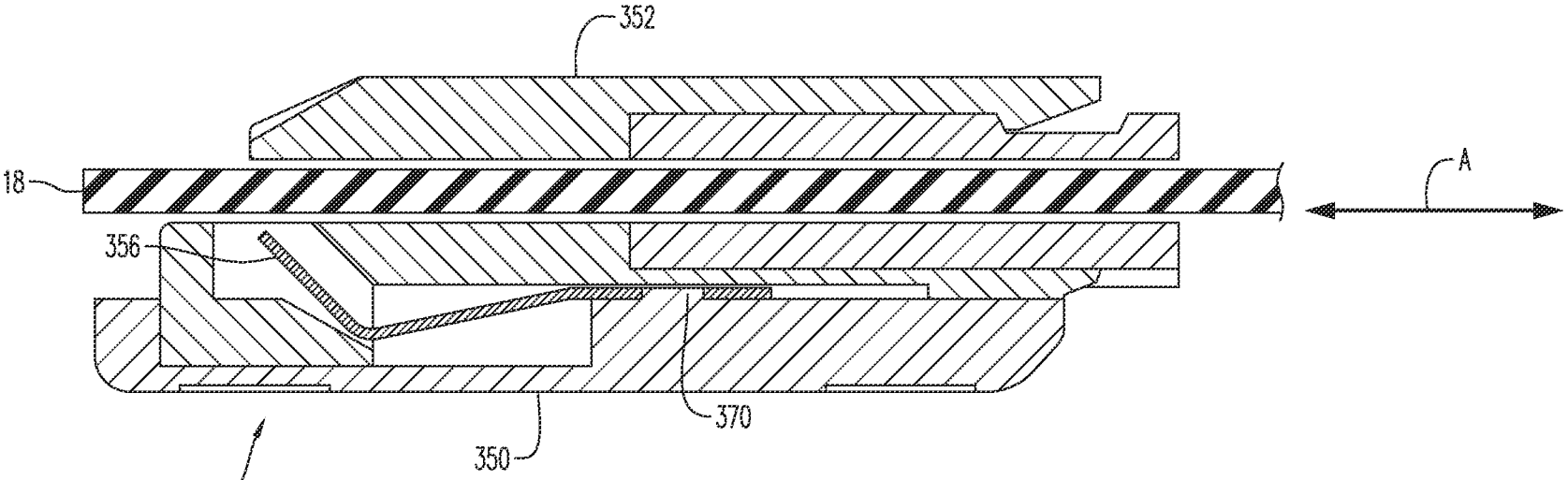
FIG. 28 is a sectional view of the channel assembly taken along lines 11-11 in FIG. 10 illustrating an alternate embodiment of the end cap.

End caps 12 are described above by way of example as having a clamping member 56 that is fixed to stationary portion 52. Of course, it is contemplated by the present disclosure for the clamping member to be fixed to the movable portion. For example and with reference to FIG. 28, an alternate exemplary embodiment of end cap 312 is shown having clamping member 356 secured to movable portion 350.

Clamping member 356 is secured between movable and stationary portions 350, 352. In the illustrated embodiment, clamping member 356 is secured to movable portion 350 by connector 370. In this manner, clamping member 356 remains fixed with respect to movable portion 350 when the movable portion is moved between the locked and unlocked positions.

End caps 12 are described above by way of example as having a clamping member 56 as a resilient member that is biased via a cam surface. Of course, it is contemplated by the present disclosure for the clamping member to be any member that engages and disengages the wiper blade. For example and with reference to FIGS. 29 through 32, alternate exemplary embodiments of the end cap are shown.

Figure 29:
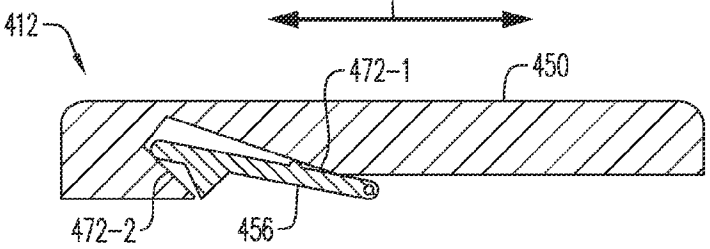
FIG. 29 is a partial sectional view of an alternate embodiment of an end cap according to the present disclosure, illustrated in an unlocked position.
Figure 30:
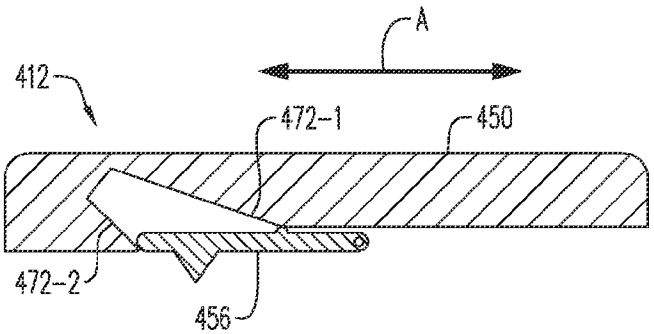
FIG. 30 is a partial sectional view of the end cap of FIG. 29 illustrated in a locked position.

In FIGS. 29 and 30, an end cap 412 is illustrated having a movable member 450 and a pivoting clamping member 456, which is pivotally secured to the stationary member (not shown). Movable portion 450 includes a first cam surface 472-1 that engages clamping member 456 as the movable portion is moved from the unlocked position to the locked position along axis A (i.e., towards the right in FIGS. 29 and 30).

Movable portion 450 also includes a second cam surface 472-2 that engages clamping member 456 as the movable portion is moved from the locked position to the unlocked position along axis A (i.e., towards the left in FIGS. 29 and 30).

In this manner, end cap 412 is configured to move clamping member 456 into and out of engagement with the wiper blade as desired.

Figure 31:
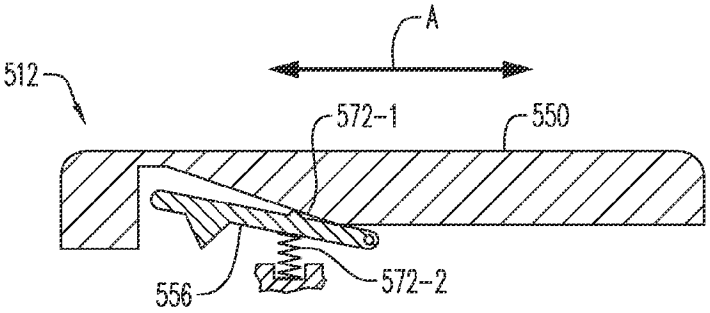
FIG. 31 is a partial sectional view of another alternate embodiment of an end cap according to the present disclosure, illustrated in an unlocked position.
Figure 32:
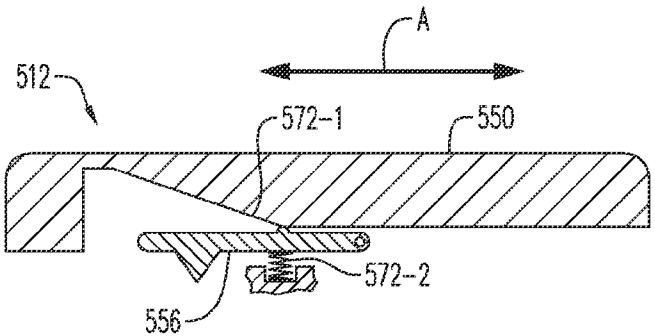
FIG. 32 is a partial sectional view of the end cap of FIG. 31 illustrated in a locked position.

In FIGS. 31 and 32, an end cap 512 is illustrated having a movable member 550 and a pivoting clamping member 556, which is pivotally secured to the stationary member (not shown).

Movable portion 550 also includes a cam surface 572-1 that engages clamping member 556 as the movable portion is moved from the locked position to the unlocked position along axis A (i.e., towards the left in FIGS. 31 and 32).

Movable portion 550 also includes a spring member 572-2 that normally biases clamping member 556 to the position shown in FIG. 31, namely out of engagement with the wiper blade. Movement of movable portion 550 to the locked position overcomes the biasing force of spring member 572-2 to move the clamping member 556 into engagement with the wiper blade, while movement of movable portion 550 to the unlocked position results in spring member 572-2 returning clamping member 556 to a position out of engagement with the wiper blade.

In this manner, end cap 512 is configured to move clamping member 556 into and out of engagement with the wiper blade as desired.

It should also be noted that the terms "first", "second", "third", "upper", "lower", "inward", "outward", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling therein.

What is claimed is:

1. A method of securing a wiper blade in a channel, comprising:

connecting a first end cap to an end of the channel;

moving a movable portion of the first end cap to an unlocked position;

inserting the wiper blade into the channel; and moving the movable portion of the first end cap to a locked position such that a clamping member of the first end cap engages the wiper blade.

2. The method as in claim 1, further comprising putting the wiper blade into a tensed condition.

3. The method as in claim 2, wherein the step of putting the wiper blade into a tensed condition comprises moving the movable portion of the first end cap to the locked position such that the clamping member of the first end cap tenses the wiper blade.

4. The method as in claim 2, wherein the step of putting the wiper blade into a tensed condition comprises pulling on the wiper blade then moving the movable portion of the first end cap to the locked position.

5. The method as in claim 2, wherein the step of putting the wiper blade into a tensed condition comprises moving the movable portion of the first end cap to the locked position then pulling on the wiper blade.

6. The method as in claim 1, further comprising:

connecting a second end cap to an opposite end of the channel;

moving a movable portion of the second end cap to an unlocked position before inserting the wiper blade into the channel; and moving the movable portion of the second end cap to a locked position such that a clamping member of the second end cap engages the wiper blade.

7. The method as in claim 6, further comprising putting the wiper blade into a tensed condition.

8. The method as in claim 7, wherein the step of putting the wiper blade into a tensed condition comprises moving the movable portion of the first and second end caps to the locked position such that the clamping member of the first and second end caps tenses the wiper blade.

9. The method as in claim 7, wherein the step of putting the wiper blade into a tensed condition comprises: moving the movable portion of one of the first and second end caps to the locked position, and pulling on the wiper blade then moving the movable portion of the other of the first and second end caps to the locked position.

10. The method as in claim 7, wherein the step of putting the wiper blade into a tensed condition comprises moving the movable portion of the first and second end caps to the locked position then pulling on the wiper blade.

11. The method as in claim 1, wherein inserting the wiper blade into the channel further comprises inserting the wiper blade in an inner profile of the first end cap.

12. The method as in claim 1, wherein the step of connecting the first end cap to the end of the channel comprises inserting an engagement region of the first end cap axially inward over an outer profile of the end of the channel.

13. The method as in claim 12, further comprising forming a press-fit connection between an inner profile of the engagement region and the outer profile of the channel.

14. The method as in claim 12, wherein the step of connecting the first end cap to the end of the channel further comprises:

causing a first locking member of the engagement region to deflect as the engagement region is axially inserted over the outer profile of the end of the channel; and returning the first locking member to a normal position with at least a portion of the first locking member interacting with a portion of the channel to prevent outward axial movement of the first end cap.

15. The method as in claim 1, wherein moving the movable portion of the first end cap to the locked position comprises axially moving the movable portion or rotating the movable portion.

16. The method as in claim 1, wherein the clamping member compresses the wiper blade against the channel.

17. A method of securing a wiper blade in a channel, comprising:

providing an end cap at each end of the channel so that a portion of the wiper blade extends through the end caps, at least one of the end caps having a movable portion that moves between a locked position and an unlocked position and having a clamping member; and moving the movable portion to the locked position such that the clamping member engages the wiper blade.

18. The method as in claim 17, wherein moving the movable portion to the locked position comprises axially moving the movable portion or rotating the movable portion.

19. The method as in claim 17, further comprising maintaining the wiper blade into a tensed condition with the clamping member engaging the wiper blade.

20. The method as in claim 17, wherein both of the end caps have the movable portion that moves between the locked position and the unlocked position and have the clamping member, the method further comprising moving the movable portion of both end caps to the locked position such that the clamping members engage the wiper blade.

* * * * *